United States Patent [19]

Tauschek

[11] 4,003,353

[45] Jan. 18, 1977

[54] VALVE ROTATOR

[75] Inventor: Max J. Tauschek, South Euclid, Ohio

[73] Assignee: TRW Inc., Cleveland, Ohio

[22] Filed: Apr. 23, 1975

[21] Appl. No.: 570,637

[52] U.S. Cl. ..... 123/90.23; 74/56

[51] Int. Cl.[2] ..... F01L 1/26

[58] Field of Search ..... 123/90.30, 90.23, 80 C, 123/80 BC, 80 D; 137/331; 74/56

[56] References Cited

UNITED STATES PATENTS

| | | | |
|---|---|---|---|
| 2,686,508 | 8/1954 | Ralston | 123/90.3 |
| 2,714,375 | 8/1955 | Hirschberger | 123/90.3 |
| 2,767,696 | 10/1956 | Engemann | 123/90.3 |
| 2,775,232 | 12/1956 | Witzky | 123/90.3 |
| 2,827,886 | 3/1958 | Greer | 123/90.3 |
| 2,835,236 | 5/1958 | Dodd | 123/90.3 |
| 2,935,058 | 5/1960 | Dooley | 123/90.3 |

*Primary Examiner*—Samuel Scott
*Assistant Examiner*—Wesley S. Ratliff, Jr.

[57] ABSTRACT

A valve rotator includes first and second parts which are mounted for movement relative to one another axially and rotatably along and about a longitudinal axis. Rotation imparting means is positioned between the parts for imparting a predetermined angular degree of relative rotation therebetween upon movement of the parts toward one another, and for imparting a different angular degree of relative rotation therebetween in an opposite rotational direction upon movement of the parts away from one another.

20 Claims, 10 Drawing Figures

VALVE ROTATOR

BACKGROUND OF THE INVENTION

This application pertains to the art of motion conversion mechanisms, and more particularly, to such mechanisms for converting axial motion into rotational motion. The invention is particularly applicable to valve rotators for imparting rotation to reciprocating valves on internal combustion engines and will be particularly described with reference thereto. However, it will be appreciated that the invention has broader aspects and may be used for imparting rotational movement to other reciprocating members.

It is common to rotate inlet or exhaust valves on internal combustion engines for such purposes as providing uniform heating to minimize distortion and one-sided overheating, along with minimizing formation of carbonized oil residue on the head and stem sections of the valve.

The most common type of valve rotator operates for rotating the valve during opening movement thereof. One known rotator of this type includes first and second parts movable axially and rotatably relative to one another. Shiftable or movable members in the form of spherical balls are positioned between the two parts on inclined ramps and a spring disc normally holds the parts separated from one another. During opening movement of the valve, the force of the valve spring increases until it overcomes the biasing force of the spring disc and causes the parts to move toward one another so that the balls roll down the ramps for imparting relative rotation to the parts and rotate the valve.

In many instances, it is desirable and necessary to rotate the valve only during opening movement thereof to minimize wear which might occur by rotational movement of the valve head against the valve seat as the valve closes. However, in certain other applications, rotation of the valve during closing is desirable in order to wipe the valve head and seat. In one known arrangement of this type, the two parts of the rotator do not move axially relative to one another and a separate axially movable sleeve member is provided for acting on the spring disc outwardly of the two rotator parts. The spring disc normally forces the balls to the deep ends of the ramps against the biasing force of return coil springs acting on the balls for urging them toward the shallow ends of the ramps. During opening movement of the valve, the force of the valve spring increases and acts on the sleeve member for moving it axially to move the spring disc away from the balls and allow the coil springs to move the balls to the shallow ends of the ramps. As the valve moves toward its closed position and the force of the valve spring decreases, the sleeve member moves away from the spring disc which then acts upon the balls for rolling them down the ramps and imparting relative rotation to the parts. Therefore, the valve is rotating somewhat as it closes in order to wipe the valve head and valve seat of deposits, and insure good seating of the valve head against the valve seat.

In some instances, it is desirable to rotate the valve during both opening and closing movement thereof, with rotation in one direction of movement being greater than in the other so that the net positive or negative rotation progressively steps the valve rotatably. One known arrangement of this type combines the two valve rotators of the type previously described. The two rotator parts do not shift axially relative to one another and each has inclined ramps on which rollable balls are positioned. A spring disc positioned between the balls on the two parts is acted upon by a separate axially movable sleeve member which moves under the force of the valve spring. During opening movement of the valve, the force of the valve spring increases for axially moving the sleeve member to deform the spring disc which acts against the balls on one rotator part for moving them down their ramps and providing relative rotation in one direction. During such movement, the ball springs for the balls on the other part were free for shifting such balls to the shallow ends of their ramps. Upon closing movement of the valve, the sleeve member moves away from the spring disc due to the decreasing force of the valve spring so that the spring disc forces the balls on the other part down their inclined ramps to impart relative rotation in an opposite direction. In such an arrangement, a multiple spring disc is required in order to obtain a greater angular degree of relative rotation in one direction than in the other. An arrangement of this type is extremely complicated because it requires an additional sleeve member, along with multiple spring discs and balls positioned on inclined ramps on both of the rotator parts.

Another arrangement for rotating a valve different degrees of angular movement during opening and closing movement thereof is disclosed in U.S. Pat. No. 2,935,058 issued May 3, 1960, to Dooley. In the Dooley arrangement, the two rotator parts are mounted in such a manner that a separating force applied thereto would act against the valve spring in the direction of valve opening movement, rather than in the direction of valve closing movement. This means that the biasing means for axially separating the parts cannot have a magnitude intermediate the valve closed and valve open forces applied by the valve spring because the biasing means would then tend to hold the valve open and prevent complete closing thereof unless extremely accurate adjustment of the rocker arm was maintained.

The Dooley arrangement includes one rotator part 8 which is fixed against axial movement relative to valve stem 4 but is free to rotate relative thereto. Another rotator part 10 is movable toward part 8 and also rotates relative to part 8 for imparting rotation to the valve during opening movement thereof. The valve spring in Dooley is coiled in such a manner that rotation of part 10 by rolling movement of the balls down the ramps also tends to rotate part 8 which then applies torque to the valve spring for winding it up and storing energy during opening movement of the valve. During closing movement of the valve, the energy stored in the valve spring is released as the valve spring unwinds so that part 8 is rotated in an opposite direction to that imparted thereto by the rolling balls, and such rotation presumably acts through the balls to rotate part 10 and the valve in an opposite direction during closing movement thereof to an angular degree less than that imparted thereto during opening movement thereof. The Dooley arrangement is very complicated, and relies upon relatively unreliable winding and unwinding movement of the valve spring. The valve spring is not really a part of the rotator mechanism itself. The relative winding strength of the valve spring may vary due to differences in heat treating and other manufacturing operations so that reliable reverse rotation a predetermined angular degree is not always possible. It is also possible for workers to assemble the valve spring reversed so it would not coil up to store energy during opening movement of the valve. Relying upon stored energy in the valve spring also makes it necessary for part 8 to rotatably act in a direction for rolling the balls up the ramps during closing movement of the valve. Therefore, the balls may simply roll or slide all the way up the ramps without imparting any reverse rotation to the valve, or have such reverse rotation completed before the valve is just closing so it will not rotatably wipe against the valve seat.

SUMMARY OF THE INVENTION

A valve rotator of the type described includes first and second parts which are mounted for movement axially and rotatably relative to one another along and about a longitudinal axis.

In accordance with an important aspect of the invention, rotation imparting means, which forms part of the rotator itself, is positioned between the two parts for imparting relative rotation to the parts in one direction during relative axial movement therebetween in one axial direction, and for imparting opposite relative rotation to a different angular degree during relative axial movement of the parts in the other axial direction. Locating such rotation imparting means between the two rotator parts themselves greatly simplifies the construction and assembly of the rotator, and insures reliable operation for imparting different angular degrees of relative rotation in opposite directions.

In one arrangement, the rotation imparting means comprises a plurality of movable members which include certain movable members for imparting relative rotation between the parts in one direction to a predetermined angular degree, and certain other movable members for imparting relative rotation between the parts in an opposite direction to a different angular degree. In a preferred arrangement, the movable members are positioned on inclined ramps for rolling movement along paths.

In accordance with the invention, the certain other movable members move along ramps having a steeper slope than the ramps along which the certain movable members move. During axial movement of the parts in one axial direction, the certain other movable members fall away from their ramps so that relative rotation is imparted to the parts by movement of the certain movable members along their more gradually sloping ramps. During axial movement of the parts in the opposite axial direction, return coil springs force the movable members up their ramps, and the certain other movable members on the more steeply sloping ramps roll upwardly more quickly and apply a greater reaction force between the parts for positively producing opposite relative rotation to a lesser angular degree, while the certain movable members on the more gradually sloping ramps partly roll and partly slide upwardly. Therefore, a net positive rotation of the valve is achieved during each opening and closing cycle thereof.

In another embodiment of the invention, the movable members move along paths, and the paths along which the certain other movable members move are located at greater radial distances from the longitudinal axis than the certain movable members.

The improved valve rotator of the present invention is preferably used in an assembly of the type which includes a valve spring for normally biasing the valve toward its closed position and also acting to bias the two rotator parts toward one another with variable forces which alternately increase and decrease between minimum and maximum force values as the valve closes and opens. Biasing means between the two rotator parts provides a separating force having a magnitude intermediate the minimum and maximum force values, and biases the two parts away from one another against the force of the valve spring in a direction tending to close the valve. The movable members impart a predetermined degree of angular relative rotation between the parts in one rotatable direction as the minimum force value increases toward the maximum force value, and impart a different angular degree of relative rotation to the parts in an opposite direction as the maximum force value decreases toward the minimum force value.

In a preferred arrangement, the movable members are positioned for rolling movement along inclined ramps, and may comprise spherical balls which are normally biased toward the shallow ends of the ramps by return coil springs.

It is a principal object of the present invention to provide an improved valve rotator which rotates different angular degrees in opposite rotational directions during opening and closing movement of a valve.

Another object of the invention is to provide such a valve rotator wherein the rotation imparting means for positively imparting different angular degrees of relative rotation in opposite directions is located entirely between the two rotator parts.

A further object of the invention is to provide such a valve rotator which has a minimum number of parts and is very reliable in operation.

An additional object of the invention is to provide such a valve rotator which has ramps inclined at different slopes so that movable members moving along the ramps having more gradual slopes impart relative rotation in one direction, while the movable members moving along the steeper ramps impart relative rotation in an opposite direction.

A still further object of the invention is to provide such a rotator wherein the movable members move along ramps having the same slope, and with certain movable members being movable along paths which are located at greater radial distances from the longitudinal axis of the two parts than the paths along which the other movable members move.

DESCRIPTION OF PREFERRED EMBODIMENTS

Figure 1:
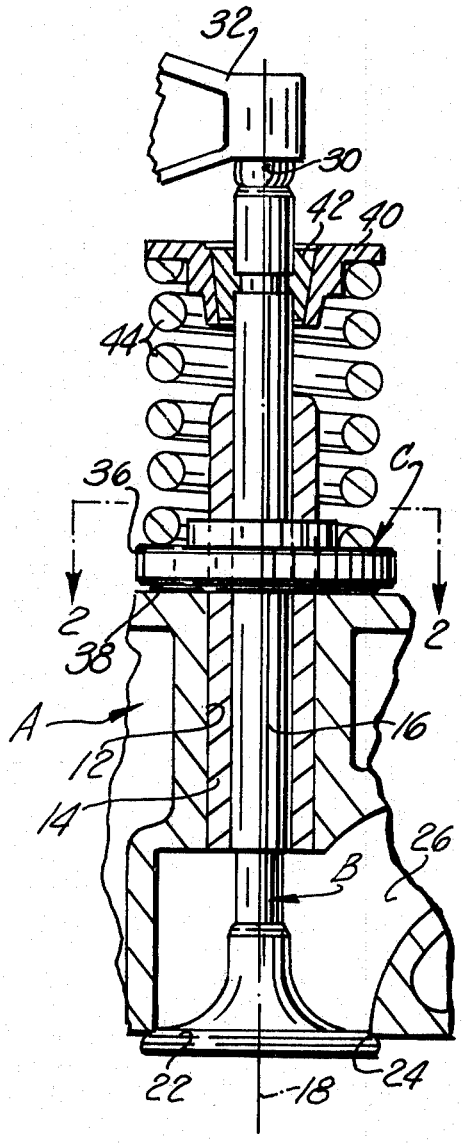
FIG. 1 is a partial cross-sectional elevational view showing a reciprocating valve having the improved rotator of the present invention assembled therewith.

With reference to the drawing, FIG. 1 shows a portion of an internal combustion engine cylinder head A having a bore 12 receiving an elongated guide sleeve 14 in which elongated cylindrical stem 16 of valve B is mounted for reciprocating and rotational movement along and about longitudinal axis 18. Valve B includes a valve head 22 which cooperates with a seat 24 surrounding an opening leading from an engine combustion chamber to an exhaust passage 26. Valve stem 16 has an upper tip end 30 acted upon by a rocker arm 32 which successively rocks downwardly and upwardly to successively open and close valve B.

Valve rotator C includes first and second parts 36 and 38, with second part 38 being fixed against axial and rotational movement to either sleeve 14 or cylinder head A. Frictional engagement of such second part 38 with cylinder head A under the biasing force of a valve spring may be sufficient to fix such part against rotational movement. First rotator part 36 is free to move axially and rotatably along and about longitudinal axis 18 relative to second part 38.

A valve spring retainer 40 is secured to valve stem 16 against rotatable and axial movement relative thereto by a lock member 42. A coiled valve spring 44 is positioned between rotator C and spring retainer 40 for normally biasing valve B upwardly in FIG. 1 in a direction to engage valve head 22 with valve seat 24. Valve spring 44 also bears against first rotator part 36 for urging same toward second rotator part 38. When first rotator part 36 rotates, its rotational movement is imparted to valve B through valve spring 44 and valve spring retainer 40.

Figure 3:
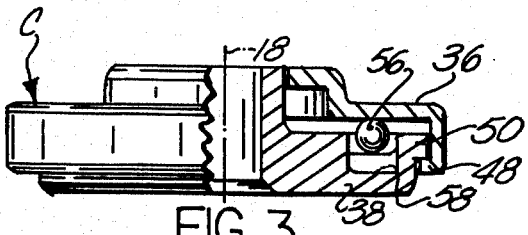
FIG. 3 is a partial cross-sectional elevational view looking generally in the direction of arrows 3—3 of FIG. 2.

As best shown in FIG. 3, first rotator part 36 has a bottom inwardly extending portion 48 which projects beneath an outwardly extending flange 50 on second rotator part 38 to prevent complete axial separation of such parts while permitting relative rotation of first part 36 relative to second part 38. Second rotator part 38 has a plurality of circumferentially-spaced grooves 52 therein arranged symmetrically about longitudinal axis 18, and including at least one groove 54 which is different from grooves 52 in a manner which will be apparent as the description proceeds.

Each groove 52 and 54 movably receives a movable member 56 which may be in the form of a spherical ball. Each groove 52 has an inclined bottom 58 which defines a sloping ramp, while groove 54 has an inclined bottom 60 defining another sloping ramp. Opposite ends 64 and 66 of grooves 52 generally define shallow and deeper ends of sloping ramps 58, while opposite end portions 68 and 70 of groove 54 generally define shallow and deeper end portions of sloping ramp 60.

Each groove receives return coil springs 74 having one spring end bearing against groove ends 66 or 70, and an opposite spring end bearing against movable members 56. Such springs 74 act in a direction for moving movable members 56 upwardly along sloping ramps 58 and 60.

With reference to FIG. 1, valve spring 44 always acts in a direction against spring retainer 40 for biasing valve B in a closing direction to engage valve head 22 with valve seat 24. As rocker arm 32 rocks downwardly, valve head 22 moves to an open position away from valve seat 24 and valve spring 44 is compressed so that the axial force it applies is increased. The force applied by valve spring 44 is a minimum when valve B is closed, and is a maximum when valve B is fully open.

Figure 4:
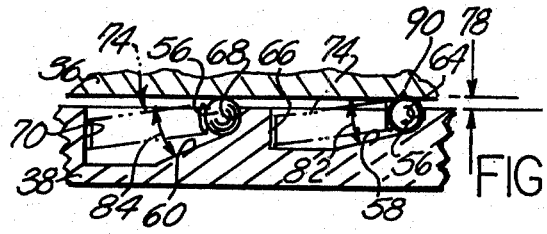
FIG. 4 is a cross-sectional elevational view looking generally in the direction of arrows 4—4 of FIG. 2.

In general, valve spring 44 may be referred to as a variable force applying means which applies variable forces which alternately increase and decrease between minimum and maximum force values as valve B moves between its closed and open positions. In the arrangement shown, coil springs 74 acting upon movable members 56 define biasing means for applying a separating force between first and second rotator parts 36 and 38 to move first part 36 axially away from second part 38. Springs 74 have a biasing strength such that the separating force has a magnitude intermediate the minimum and maximum force values applied by valve spring 44. Therefore, when valve B is closed as shown in FIG. 1, springs 74 apply a force sufficient to move movable members 56 up ramps 58 and 60 so that such movable members hold rotator parts 36 and 38 axially separated from one another by a distance 78 as shown in FIG. 4. Obviously, the movable members in the form of spherical balls 56 have a diameter greater than the depth of shallow ramp ends 64 and 68 in order to provide such axial separation of the two rotator parts in the closed position of valve B.

In the rotator of the present application, the rotation imparting means defined by movable members 56 is arranged to limit reverse rotation of part 36 relative to part 38. In other words, the rotation imparting means provides a predetermined angular degree of rotation of part 36 with respect to part 38 in one rotational direction, while providing a different angular degree of rotation of part 36 with respect to part 38 in the opposite rotational direction. Preferably, the different degree of angular rotation is substantially less than the predetermined angular degree of rotation in order that a net positive rotation will occur to progressively rotatably step valve B in a circular path.

As shown in FIG. 4, ramp 58 is sloped at an angle 82, while ramp 60 is sloped at a greater angle 84. The separating force applied by return springs 74 for movable members 56 is greater than the load applied by valve spring 44 in the closed position of the valve, but less than the load of spring 44 in the open position of the valve. The required force of return springs 74 can be determined from the equation:

$$F_R = \frac{N_{82}F_{82}}{\text{Sine } 82} + \frac{N_{84}F_{84}}{\text{Sine } 84}$$

In the equation, $F_R$ equals the reaction force; $N_{82}$ equals the number of grooves with ramp angles 82; $F_{82}$ equals the force of springs 74 in the grooves having ramp angles 82; $N_{84}$ equals the number of grooves with ramp angles 84; and $F_{84}$ equals the return force of springs 74 on the ramps having angles 84. The return force of the return springs on the different ramps may be adjusted to minimize Hertz loads on the balls and their mating parts, although it will be appreciated that the same ball return springs may be used on all of the ramps if so desired.

As valve B is moved toward its open position by rocker arm 32, the force of valve spring 44 increases until it overcomes the separating force provided by return springs 74. At that time, movable members 56 begin to roll down their respective ramps 58 and 60. A given point 90 on part 36 in FIG. 4 will move from line 94 in FIG. 5 to line 96 as part 36 moves toward part 38 because the rotational movement imparted to first part 36 is equal to the double rolling distance through which movable members 56 move down ramps 58. Movable member 56 on ramp 58 will itself move from line 94 to line 98 and this distance is represented by Y. The movement of the given point 90 is substantially equal to the distance 2Y between lines 94 and 96.

Figure 5:
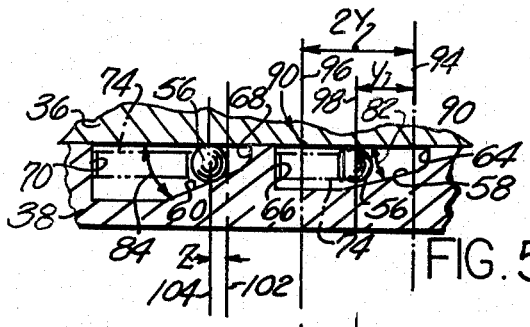
FIG. 5 is a view similar to FIG. 4, and showing two rotator parts and movable members in a different position.

During movement of part 36 toward part 38 as the movable members begin to roll down their respective ramps, movable member 56 on ramp 60 tends to fall away from such ramp due to its steeper slope, and the reaction force between the two parts and the movable members is taken by those movable members on ramps 58 so that movable member 56 on ramp 60 moves through a distance indicated by Z in FIG. 5 between lines 102 and 104. During this movement of part 36 toward part 38, as the force of valve spring 44 increases, movable members 56 roll in a counterclockwise direction down their respective ramps as viewed in FIGS. 4 and 5.

When valve B begins its movement from the fully open position toward the closed position, and the force of valve spring 44 is decreasing from its maximum force value toward its minimum force value, springs 74 force movable members 56 up their respective ramps to apply a separating force for moving first rotator part 36 axially away from second rotator part 38. During this movement, balls 56 rotate in a clockwise direction up their ramps for imparting reverse rotation to part 36 relative to part 38. Movable member 56 on steeper ramp 60 moves upwardly more rapidly than the movable members on the more gradually sloping ramps so that the maximum reaction force between parts 36 and 38 is acting on movable member 56 on ramp 60. Therefore, movable member 56 on ramp 60 rotates up its ramp to rotate part 36 in an opposite direction relative to part 38 during closing movement of valve B, while movement of movable members 56 up ramps 58 is partly rolling and partly sliding. Movable member 56 on ramp 60 moves through a total distance indicated by Z and movement of given point 90 from line 96 to line 98 is equal to the double rolling stroke of movable member 56 on ramp 60, or a total distance generally equal to 2Z.

Figure 2:
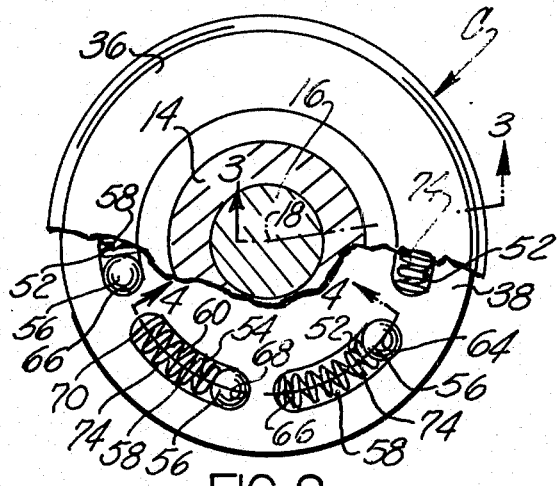
FIG. 2 is a partial cross-sectional plan view looking generally in the direction of arrows 2—2 of FIG. 1, and with portions omitted for clarity of illustration.

The net positive rotation of part 36 relative to part 38 is generally equal to the distance 2Y−2Z. As viewed in FIG. 2, part 36 rotates in a clockwise direction relative to part 38 during opening movement of valve B by a distance 2Y, and rotates in a counterclockwise direction relative to part 38 by a distance 2Z during closing movement of valve B. Therefore, a net positive rotation in the clockwise direction is achieved and is generally equal to 2Y−2Z.

In the arrangement shown in FIGS. 2–6, the ramps are shown with their longitudinal axes lying on the circumference of a circle drawn about longitudinal axis 18. However, it will be appreciated that it is possible to arrange such ramps so that the movable members move along straight lines, and can also move somewhat radially relative to longitudinal axis 18 in order to spread wear over a larger radial area on part 36. Opposite ends 64 and 66 generally define the limits of paths along which movable members 56 on ramps 58 move, while opposite ends 68 and 70 for ramps 60 generally define movement paths for the movable members positioned on such ramps.

Figure 6:
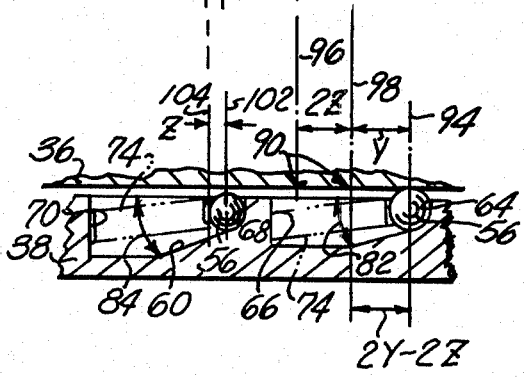
FIG. 6 is a view similar to FIGS. 4 and 5, and showing how different degrees of relative rotation occur between the parts of the rotator.
Figure 7:
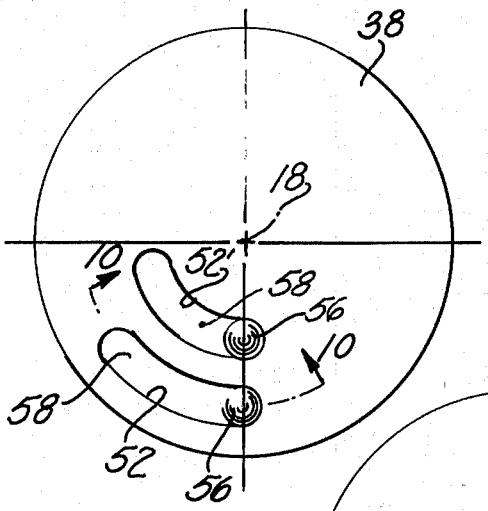
FIG. 7 is a somewhat diagrammatic cross-sectional plan view similar to FIG. 2, and showing another embodiment of the invention.

As explained with reference to FIGS. 4–6, movable members 56 on ramps 60 move through a substantially shorter path than such movable members on ramps 58 during operation of the rotator. Preferably, at least one ramp 60 having a greater slope than the other ramps is provided in order to achieve less rotation in a reverse direction, although it will be appreciated that an equal number of steeper and more gradually sloping ramps may be provided if so desired. Preferably, the ramps are arranged symmetrically about longitudinal axis 18.

FIGS. 7–10 show another embodiment of the invention wherein grooves 52' are located radially inwardly from grooves 52. In the arrangement of FIGS. 7–10, all of grooves 52 and 52' have bottoms defining sloping ramps 58 which slope at the same angle 82. Grooves 52 and 52' are preferably positioned such that the centers of movable members 56 lie on a common radial line from longitudinal axis 18 when such movable members are at the top or shallow ends of the ramps. It will be recognized that it is most desirable to provide a plurality of grooves 52 and 52' arranged symmetrically about longitudinal axis 18. In the arrangement of FIGS. 7–10, ball return springs 74 of FIGS. 2–6 are not shown but it will be recognized that they are used in the same manner for providing a separating force between the parts which has a magnitude intermediate the minimum and maximum force values provided by valve spring 44 as valve B moves between its closed and open positions.

Figure 8:
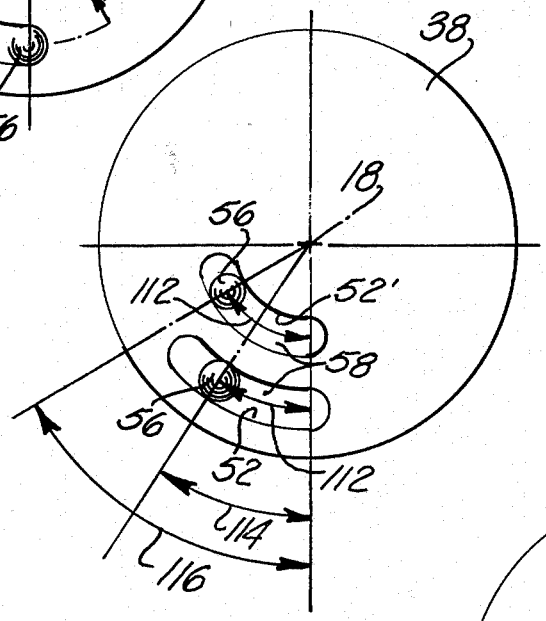
FIG. 8 is a view similar to FIG. 7 and showing movable members in a different position.
Figure 9:
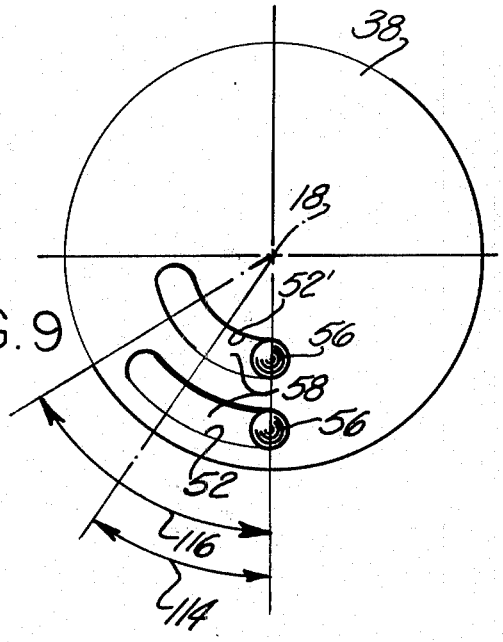
FIG. 9 is a view similar to FIGS. 7 and 8, and showing how different degrees of relative rotation occur between the rotator parts.
Figure 10:
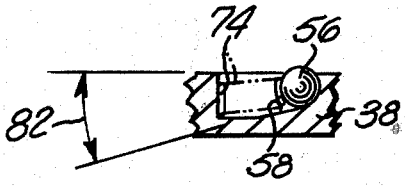
FIG. 10 is a cross-sectional elevational view looking generally in the direction of arrows 10—10 of FIG. 7.

In the arrangement of FIGS. 7–10, as the valve opens and the force of the valve spring increases toward its maximum value, the force of the return springs for the movable members is overcome so that the first rotator part moves toward second rotator part 38 for causing movable members 56 to roll down their respective ramps 58. In view of the fact that all of ramps 58 for outer and inner grooves 52 and 52' slope downwardly at the same angle, movable members 56 must traverse the same absolute circumferential distance 112 as shown in FIG. 8. Therefore, movable members 56 in grooves 52 move through an angle 114, while movable members 56 in grooves 52' move through an angle 116. In other words, the movement of the movable members down their ramps in grooves 52 is partly rolling and partly sliding as the movable members in inner grooves 52' roll completely down their ramps through angle 116. As inner movable member 56 rolls down ramp 58, the member 36 is rotated through the angular distance 116. During this time period outer movable member 56 moves through angular distance 114 and sliding movement occurs between member 36 and the outer movable member 56.

As the valve returns toward its closed position and the force of the valve spring decreases from its maximum toward its minimum force value, the return springs for the movable members move such members up their respective ramps for providing reverse rotation of part 36 relative to part 38. The movable members in outer grooves 52 roll up their ramps and need move only through an angle 114 before they reach the shallow ends of their ramps so that parts 36 and 38 are completely separated from one another, while the movable members in inner grooves 52' must move through angle 116. Therefore, return movement of the movable members in grooves 52 is rolling until complete separation of parts 36 and 38 is achieved, while movement of the movable members in inner grooves 52' is partly rolling and partly sliding. Therefore a net positive rotation of the part 36 is achieved and is generally equal to angle 116 less angle 114.

In the arrangement of FIGS. 7–10, the movable members move along paths which are radially-spaced from one another outwardly of longitudinal axis 18, and are further arranged so that the movable members on the outer ramps will move in a partly sliding and partly rolling motion during movement of part 36 toward part 38, while the movable members on the inner ramps will move with partly rolling and partly sliding motion during movement of part 36 away from part 38.

It will be recognized that different degrees of reverse rotation can be achieved by varying the slopes of the different ramps in the embodiment of FIGS. 1–6, or by varying the radial spacing of the grooves in the embodiment of FIGS. 7–10. Although the return coil springs are used in the preferred arrangement for providing the separating force, it is obvious that certain features of the present invention can also be used with rotators of the type having a separate spring disc or other biasing means for applying the separating force.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

Having thus described my invention, I claim:

1. A mechanism for converting axial motion of an elongated stem in a guide member into rotational motion of the stem comprising; first and second parts mounted coaxially on said stem for movement toward and away from one another in axial directions along a longitudinal axis and for rotational movement relative to one another about said axis in opposite rotational directions, said stem being rotatable in response to rotation of one of said parts and the other of said parts being fixed against axial and rotational movement relative to said longitudinal axis, rotation imparting means positioned between said parts for imparting a predetermined angular degree of relative rotation to said parts in one of said rotational directions in response to axial movement therebetween in one of said axial directions and for imparting a different angular degree of relative rotation to said parts in the other of said rotational directions in response to axial movement therebetween in the other of said axial directions.

2. The mechanism of claim 1 wherein said one axial direction comprises axial movement of said parts toward one another and said different angular degree of rotation is less than said predetermined angular degree of rotation.

3. The mechanism of claim 1 wherein said rotation imparting means includes a plurality of movable members.

4. The mechanism of claim 3 wherein said movable members include first movable members for imparting relative rotation to said parts in said one rotational direction and at least one second movable member for imparting relative rotation to said parts in said other rotational direction.

5. The mechanism of claim 4 wherein said movable members comprise balls rollable along separate paths on inclined ramps on one of said parts, said second movable member being movable along a substantially shorter path than the other of said movable members.

6. The mechanism of claim 1 wherein said rotation imparting means comprises a plurality of movable members positioned between said parts for movement along separate paths and including a plurality of first movable members for imparting relative rotation to said parts in said first rotational direction and at least one second movable member for imparting relative rotation to said parts in said other rotational direction.

7. The mechanism of claim 6 wherein said second movable member moves along a path which is substantially shorter than the paths along which said first movable members move.

8. The mechanism of claim 1 and further including variable force applying means for applying variable force which alternately increases and decreases between minimum and maximum force values in a direction for moving said parts axially toward one another, and biasing means for applying a separate force between said parts for moving said parts axially away from one another, and said separating force having a magnitude intermediate said minimum and maximum force values.

9. The mechanism of claim 8 wherein said rotation imparting means comprises a plurality of spherical balls movable along sloping ramps on one of said parts in separate paths.

10. The mechanism of claim 9 wherein certain of said ramps have steeper slopes than the other of said ramps.

11. The mechanism of claim 9 wherein certain of said paths are positioned different radial distances from said longitudinal axis than the other of said paths.

12. A valve rotator of the type including a first part mounted on a valve stem for axial and rotatable movement relative to a second part also mounted on said valve stem along and about a longitudinal axis, said valve stem being rotatable in response to rotation of one of said parts, rotation imparting means positioned between said parts for imparting rotation to said first part in one rotatable direction during axial movement thereof toward said second part and for imparting a different angular degree of rotation to said first part in an opposite rotatable direction during axial movement thereof away from said second part, and means for holding the other of said parts against axial and rotational motion along and about said longitudinal axis.

13. The rotator of claim 12 wherein said rotation imparting means comprises a plurality of movable members including certain movable members operative for imparting rotation to said first part in said one rotatable direction and certain other movable members for imparting rotation to said first part in said opposite rotatable direction.

14. The rotator of claim 13 wherein said movable members move in paths along sloping ramps, said certain other movable members being movable along ramps having a steeper slope than the ramps along which said certain movable members move.

15. The rotator of claim 13 wherein said movable members move along sloping ramps on one of said parts in paths, said paths for said certain and said certain other movable members being located at different radial distances from said longitudinal axis.

16. A rotator for a valve including a valve stem which is mounted in a valve head for reciprocating movement therein between open and closed positions along a longitudinal axis and being rotatable about said axis, said rotator including first and second parts mounted adjacent one another on said valve stem, said first and second parts being movable toward and away from one another along said axis in first and second axial directions and being rotatable relative to one another about said axis in opposite first and second rotatable directions, one of said parts being positioned for imparting rotation to said valve during relative rotation therebetween, and the other of said parts being held against said valve head to prevent axial and rotational movement relative to said longitudinal axis, variable force applying means for applying variable forces to said valve which alternately increase and decrease between minimum and maximum force values as said valve moves between said closed and open positions and act in a direction for moving said valve to said closed position, said variable force applying means acting for moving said parts toward one another, yieldable biasing means for applying a separating force in a direction to move said parts away from one another, said separating force having a magnitude intermediate said minimum and maximum force values, and rotation imparting means for imparting a predetermined angular degree of relative rotation between said parts in one of said rotatable directions as said minimum force value increases toward said maximum force value and for imparting a different angular degree of relative rotation to said parts in the other of said rotatable directions as said maximum force value decreases toward said minimum force value.

17. The rotator of claim 16 wherein said rotation imparting means comprises a plurality of movable members, certain of said movable members acting for imparting relative rotation to said parts in said one rotatable direction and certain other of said movable members acting for imparting relative rotation to said parts in the other of said rotatable directions.

18. The rotator of claim 17 wherein said movable members are positioned for rolling movement along inclined ramps on one of said members and including ramps having different slopes for said certain and said certain other movable members.

19. The rotator of claim 17 wherein said movable members are positioned for rolling movement in paths along inclined ramps on one of said parts, and said paths for said certain movable members and said certain other movable members being located at different radial distances from said longitudinal axis.

20. A mechanism for converting axial motion of an elongated stem relative to a body to rotational motion of the stem about its longitudinal axis, comprising a first rotator member mounted coaxially relative to the stem for effecting rotation of the stem in response to rotation of said first rotator member, and a second rotator member adjacent the first rotator member also mounted coaxially relative to the stem, said second rotator member being fixed by said body against axial and rotational movement relative to said longitudinal axis, said first rotator member being movable toward and away from said second rotator member in axial directions along said longitudinal axis and for rotational movement relative to said second rotator member about said axis in opposite rotational directions, rotation imparting means positioned between said first and second rotator members for imparting an angular degree of relative rotation to said first and second rotator parts in one of said rotational directions in response to axial movement therebetween in one of said axial directions, and for imparting a different angular degree of relative rotation to said first and second rotator members in the other of said rotational directions in response to axial movement therebetween in the other of said axial directions; a spring coacting between said first rotator member and said elongated stem for effecting movement of the stem in one axial direction; and means for compressing said spring to move the stem in the other direction.

* * * * *